United States Patent [19]

Togni

[11] 4,142,255

[45] Mar. 6, 1979

[54] PREFABRICATED HYGIENIC-SANITARY COMPONENTS FOR BATH-ROOM AND TOILET OUTFIT

[75] Inventor: Giulio Togni, Lainate, Italy

[73] Assignee: Salvarani S.p.A, Baganzola, Italy

[21] Appl. No.: 864,873

[22] Filed: Dec. 27, 1977

Related U.S. Application Data

[63] Continuation of Ser. No. 670,950, Mar. 26, 1976, abandoned.

[30] Foreign Application Priority Data

Mar. 28, 1975 [IT] Italy ..... 21848 A/75

[51] Int. Cl.[2] ..... A47K 4/00; E03C 1/01; E03D 11/13

[52] U.S. Cl. ..... 4/1; 4/2; 4/DIG. 7; 4/191

[58] Field of Search ..... 4/1, 2–6, 4/145, 146, 159, 166, 173 R, 187 R, 191, 192, DIG. 7; 52/34, 35

[56] References Cited

U.S. PATENT DOCUMENTS

| | | | |
|---|---|---|---|
| 2,992,437 | 7/1961 | Nelson et al. | 4/192 |
| 3,095,581 | 7/1963 | Gerow et al. | 4/192 |
| 3,324,483 | 6/1967 | Conroy | 4/187 R |
| 3,523,306 | 8/1970 | Sabella | 4/159 |
| 3,590,392 | 7/1971 | Hollander | 4/2 |
| 3,590,393 | 7/1971 | Hollander | 4/192 X |
| 3,765,036 | 10/1973 | Dykstra | 4/191 X |

*Primary Examiner*—Stuart S. Levy
*Attorney, Agent, or Firm*—Stevens, Davis, Miller & Mosher

[57] ABSTRACT

A prefabricated hygienic-sanitary component, particularly for bath-room and toilet outfit, comprising a self-supporting structure in the form of a furniture piece, completely finished with panels, having at least one hygienic-sanitary appliance integral therewith, and incorporating feed and discharge pipes for said appliance, with associated faucets or taps and shut-off and throttle or regulation valves, said pipes being connected to respective pipe fittings assembled into at least one location of the structure.

2 Claims, 16 Drawing Figures

PREFABRICATED HYGIENIC-SANITARY COMPONENTS FOR BATH-ROOM AND TOILET OUTFIT

This is a continuation of application Ser. No. 670,950 filed Mar. 26, 1976, now abandoned.

BACKGROUND OF THE INVENTION

1. Field of the Invention

This invention relates to prefabricated hygienic-sanitary components for bath-room and toilet outfit.

It is well known that, at present, in most cases, bath-rooms and toilets are fitted with hygienic-sanitary appliances as the building is being erected, by stably arranging the individual appliances, such as wash-basin, bath-tub, shower, bidet and water closet bowl, at predetermined room locations, and by fixing such appliances to the building structure and connecting the same, by means of built-in pipes to the vertical feed and discharge pipes.

This conventional installation system for hygienic-sanitary facilities is getting increasingly antieconomical, in view of the high costs of skilled labour, and it hardly agrees with the modern trends of the building industry, which takes the greatest possible advantage of prefabricated components, readily transportable to a building yard and merely assemblable thereat.

2. Description of the Prior Art

Therefore, there have been proposed other systems using, for example, tridimensional type prefabricated elements, such as complete cabins or shower-cabins, or composable block systems, wherein each of the blocks incorporates at least one given facility — that is, a wash-basin, a water closet bowl, a bath-tub or the like — as well as the associated feed and discharge pipes, said block being assembled so as to form an integral part with the bath-room wall. However, also these systems do not solve the problem, since they either do not allow a desirable variability in combining and coupling different types of appliances, or they still require works of permanent hydraulic connection to wall or floor pipes, already built-in at predetermined locations as the building is being erected.

SUMMARY OF THE INVENTION

Accordingly, it is the primary object of the present invention to solve the problem of fitting such rooms, as bath-rooms and toilets, with hygienic-sanitary appliances in a thoroughly rational manner, by using prefabricated modular components combining in a single unit all of what is required for use therof, without involving the building structures, said modular components being apt to readily assume a plurality of positions, just as a standard piece of furniture, and being entirely producible in a factory and of easy transportation and shipment to the place where they have to be installed.

In other words, the invention intends to provide completely finished and equipped self-supporting components, that can be combined to one another as desired and readily connected to tap or plug locations as prearranged in a room designed to accomodate such components.

The invention solves the predeterminate problem by means of prefabricated components, characterized by comprising a self-supporting structure, completely finished with panels, having at least one hygienic-sanitary appliance integral therewith and incorporating feed and discharge pipes for said appliance, with associated faucets or taps and shutoff and throttle or regulation valves, said pipes being connected to respective pipe fittings assembled into at least one location of the structure, the latter substantially appearing as an easily movable and positionable piece of furniture.

A component of this type, as suitably made in a modular form, is completely self-contained and separated from the building structure in which it is intended to be used and, due to its functionality, it only needs to be connected — for example by partly or fully flexible above-floor pipes — to a tap-box associated to the central building system for cold and possibly hot water supply and discharge.

The component, which is per se self-supporting and hence not requiring any wall or floor fixtures, comprises the carrying structure for the hygienic-sanitary appliance(s) associated therewith, at the same time including all of the fittings, such as dispensing and discharging pipes, valves, faucets or taps, pipe fittings and the like, required for the operation of the appliances. Of course, the component could also be previously fitted with further accessories not strictly required for the operation of the related appliance, but useful to the use thereof, such as mirrors, lamps, drawers, bath fittings such as soap-dishes, article-holders, toilet-paper holders or the like.

Thus, the room designed as bath-room or toilet can be totally finished and later be provided with the desired hygienic-sanitary components which, while taking into account the prearranged position for the water intake and discharge box, can however assume varying positions according to a user's desire.

By way of example, the components according to the invention can be provided, one for the water closet bowl and bidet, one for the wash-basin, one for the bath-tub and one for the shower, but it is also possible to combine differently the hygienic-sanitary appliances relating to one component. For instance, one of such combinations could provide a single component assembling a water closet bowl and bidet at one side and a wash-basin at the opposite side.

In fact, owing to the modular nature thereof, the components can be readily assembled and coupled. A particular advantage for the builder is the possibility of furnishing a bath-room with few basic components, then leaving it to the user to complete the furnishings in accordance with his own requirements, that is, by introducing new components in successive stages, after the building is over.

Many are the advantages achieved by the hygienic-sanitary components according to the invention. Namely, the components can be used just as a fitted piece of furniture or electrical household appliance, by mere linking through flexible connection pipes to prearranged taps or plugs.

The components are completely finished in every detail at the factory and can be readily transported to the location of their use, where they are installed upon building completion, and without soiling or damaging.

Building construction times are substantially reduced, since only the main vertical pipe system is prearranged therein, and the rooms designed as bath-room or toilet are fitted with simple water intake and discharge boxes, which boxes can be provided at floor-level or on the wall. Thus, the fixed hydraulic system in a building is reduced to a minimum.

The practical construction of the individual components can very within wide ranges, provided that the basic principles of the present invention are complied with. Thus, the invention should not be considered as limited to particular constructive embodiments, but it should be intended within the general aspect of the above defined solution concept.

BRIEF DESCRIPTION OF THE DRAWINGS

Accordingly, the following detailed description will refer to simple indicative schemes of some exemplary embodiments of components according to the invention, without lingering over constructive and structural details.

In the drawings.

DESCRIPTION OF THE PREFERRED EMBODIMENTS

Figures 1, 2, 3, 4, 5, 6:
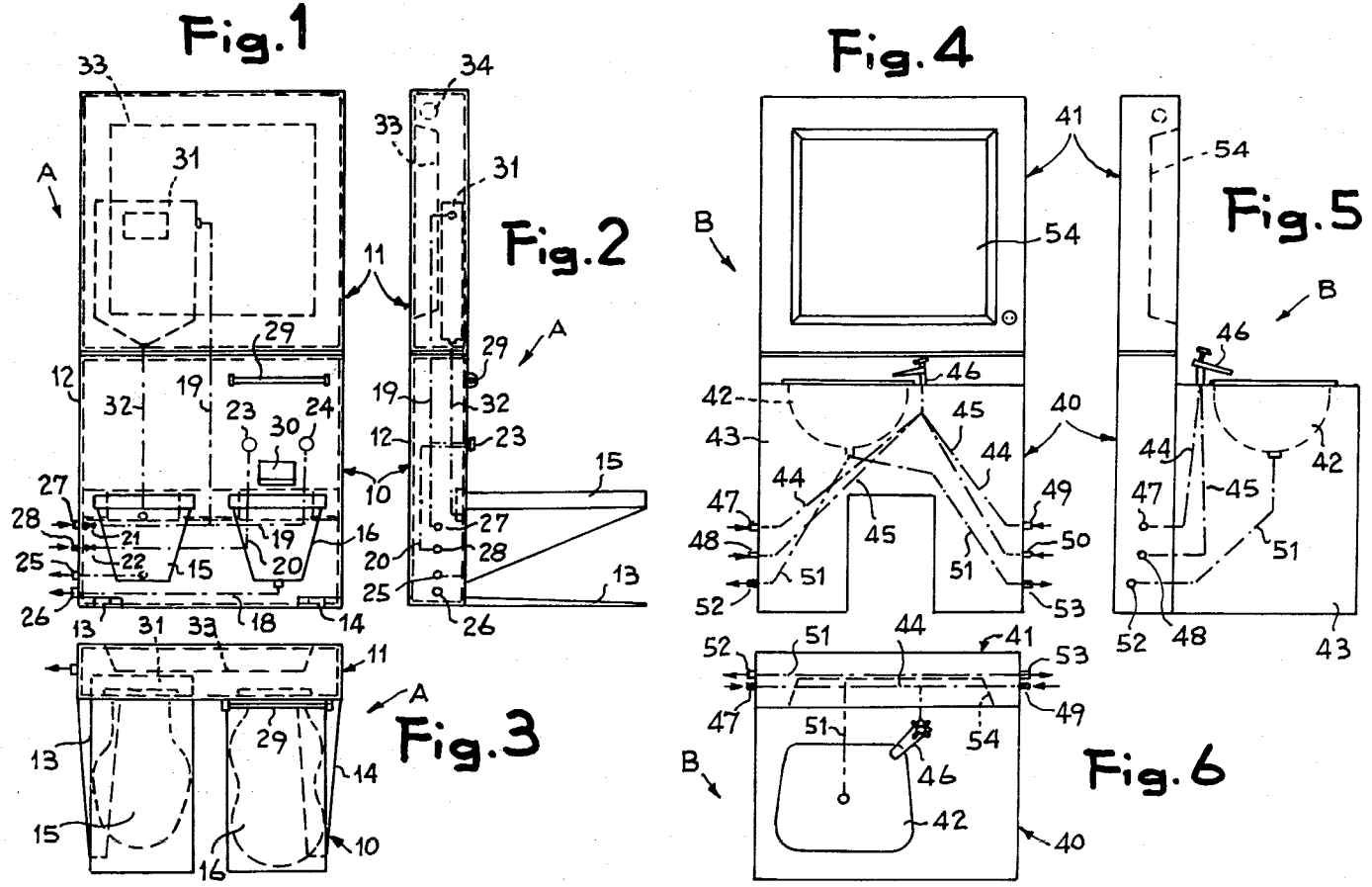
FIGS. 1–3 are, respectively, front, side and top views showing the scheme of a "water closet bowl and bidet" component.
FIGS. 4–6 are views similar to FIGS. 1–3, but showing the scheme of a "wash-basin" component.

The "water closet bowl and bidet" component according to FIGS. 1–3, generally indicated by A, comprises a base element 10, having a top completion element 11 placed above it.

This base element 10 comprises a vertical parallelepiped frame 12 finished with panels, for example of molded plastic material, to which are applied inverted brackets 13 and 14, acting as foot members for ensuring static stability of the element. A water closet bowl 15 and a bidet 16, forwardly projecting from the side of said brackets 13 and 14, are secured to the frame 12. The frame contains discharge pipes 17 and 18 for said water closet bowl 15 and bidet 16, and dispensing pipes 19 and 20, respectively for cold and hot water, with associated shut-off and throttle or regulation valves 21 and faucets or plugs 23 and 24.

Figure 12:
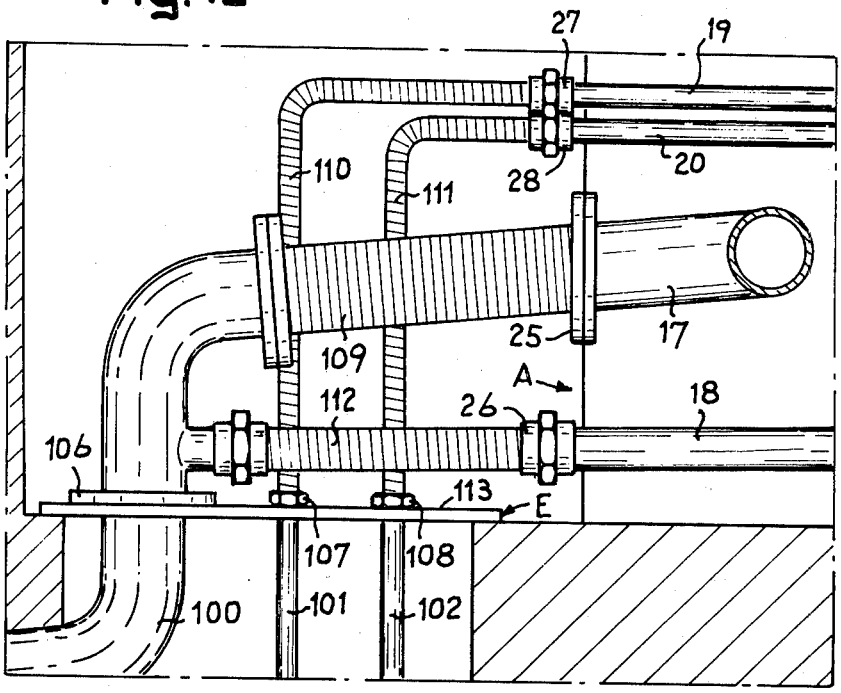
FIG. 12 is a side view showing the linking of a component to a floor-level tap or plug box.
Figure 13:
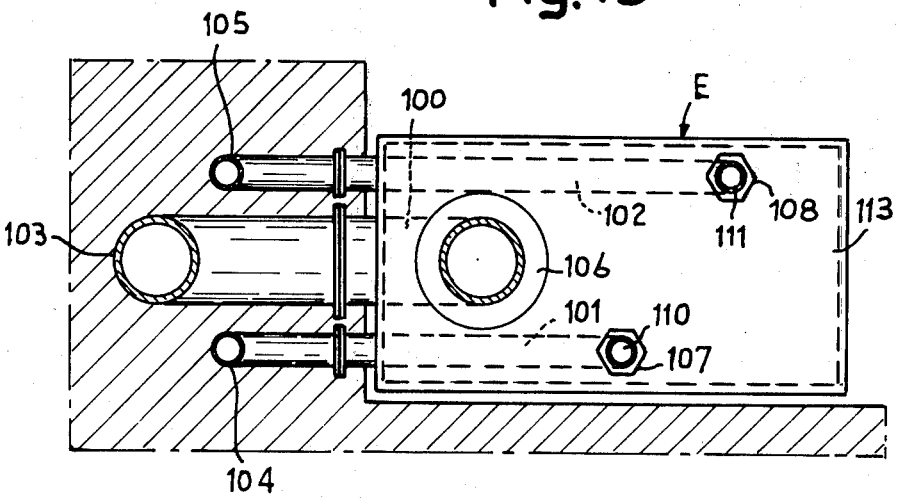
FIG. 13 is a plan view of the tap or plug box shown in FIG. 12.

The pipes 17, 18, 19 and 20 end into pipe fittings 25, 26, 27 and 28 assembled at one side of the element for connection to the respective discharge and water taps (see FIGS. 12 and 13).

Element 10 can be fitted with various fittings, such as a towel-holder 29 and a soap-dish 30 on the bidet 16.

A washing box 31 for said water closet bowl 15 — which is connected to the cold water dispensing pipe 19 and to the water closet bowl by means of a downlet tube 32 — can be arranged in the top complementary element 11, apt to be placed over said base element 10 and to be fixed thereto.

Also the complementary element 11 comprises a suitable frame completed with finishing panels. The back wall of element 11 can have a recess 33 for accomodating a mirror and a socket 34 for a lamp, in the event that such element should be used in the component hereinafter described with reference to FIGS. 4–6.

In fact, these figures show a "wash-basin" component, generally indicated by B, comprising a base element 40 and a top completion element 41.

The latter element corresponds to the element indicated by 11 in FIGS. 1–3, but for the omission of the washing box 31. The base element 40 is composed of a cabinet provided with a plane for a wash-basin 42, having side stanchions 43 which can be used as drawer assemblies. The cabinet also contains the feed pipes for cold water and hot water 44 and 45 respectively, which end into a mixer faucet or tap 46 and are connected to both left and right pipe fittings 47, 48 and 49, 50 respectively.

The outlet or discharge for the wash-basin 42 is connected through pipes 51 to pipe fittings 52 and 53, also arranged at the left and at the right of the cabinet.

The feed and discharge pipes arranged within the base cabinet 40 are schematically shown in FIGS. 4–6 by simple broken dashed lines, it being however understood that such pipes may be most suitably located to take the maximum advantage of the space inside the cabinet.

These pipes are also provided with suitable shut-off and regulation or throttle valves.

A built-in mirror 54 and further useful fittings can be arranged within said top element 41.

Figures 7, 8, 9, 10, 11:
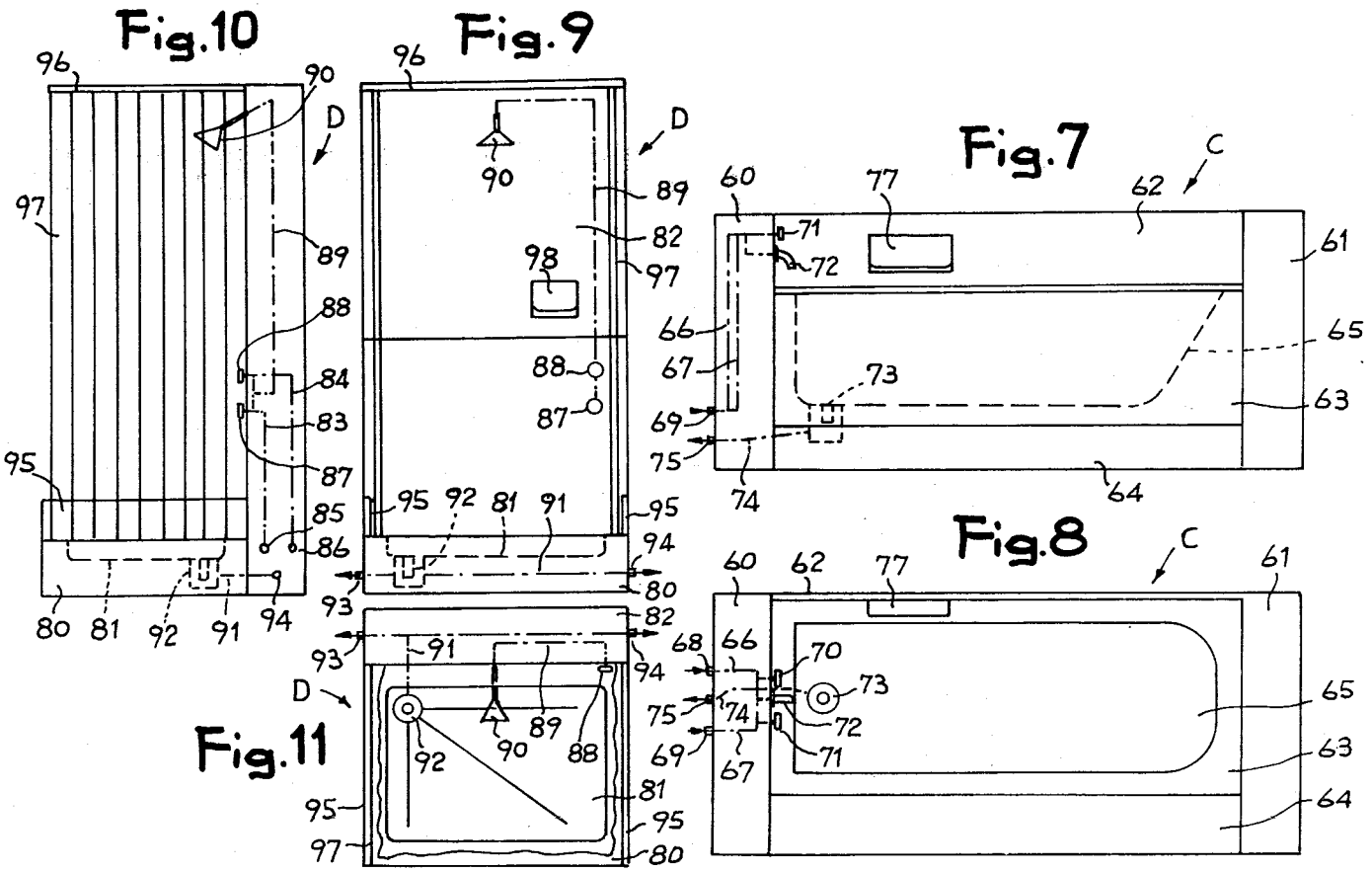
FIGS. 7 and 8 are side and top views showing the scheme of a "bath-tub" component.
FIGS. 9–11 are views similar to FIGS. 1–3, but showing a "shower" component scheme.

The "bath-tub" component, generally indicated by C in FIGS. 7 and 8, comprises two side elements 60 and 61, a vertical rear element 62 and a front element 63 forming a step 64. These elements enclose and support, through a suitable carrying structure, a bath-tub 65. Said side element 60 contains the hydraulic system with cold and hot water feed pipes 66 and 67, connecting side pipe fittings 68 and 69 to respective faucets or taps 70 and 71, to which the delivery orifice 72 is connected. The outlet or discharge 73 for said bath-tub 65 is connected through a pipe 74 to a pipe fitting 75.

The side element 61 can be used as a box, drawer assembly or the like, and the rear element 62 can carry various fittings, such as a soap-dish 77.

Of course, also this component is completely finished with external panels, for example panels of colored and/or designed molded plastic material, or tile supporting panels.

The "shower" component, generally indicated by D in FIGS. 9 and 10, comprises a substantially square base 80 supporting a shower plate 81 raised from the floor and a vertical element 82 (possibly made of two superimposed parts) which contains the hydraulic system comprising: cold and hot water inlet pipes 83 and 84, connecting side pipe fittings 85 and 86 to faucets or taps 87 and 88, respectively; a pipe 89, connecting said faucets or taps to the shower 90; and a discharge pipe 91, connecting the outlet 92 of the plate 81 to left and right side pipe fittings 93 and 94, respectively.

The base 80 can be provided with raised edges 95 and the vertical element 82 can carry at the top a support 96 for a curtain 97.

Of course, such a component can be equipped with any useful fittings such as, for example, a soap-dish 98 and the like.

All of the above described components are selfsupporting, that is, capable of standing without requiring any mechanical connections to a wall. At the most, for those components provided with high vertical elements, such as components A and B, pressure members could be provided, acting against the ceiling and easy to be assembled and disassembled, so as to give a better stability to the component, without however steadily restraining it to the wall structure.

Figure 14:
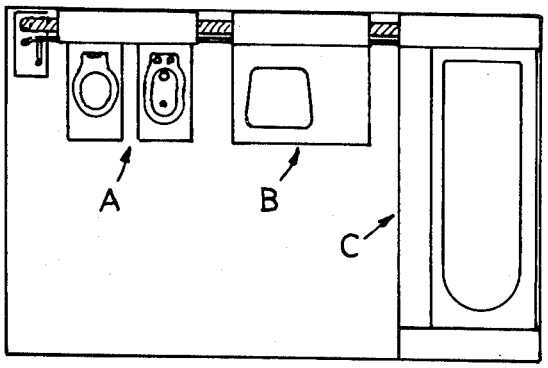
FIGS. 14–16 are plan views showing some exemplary compositions of the various components according to the preceding figures.
Figure 15:
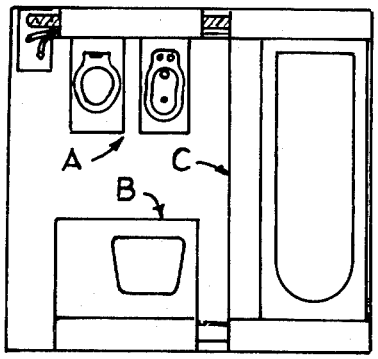
Figure 16:
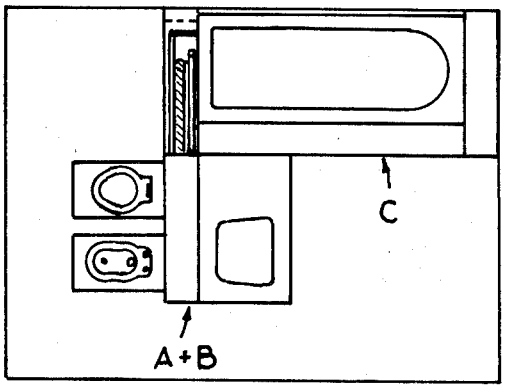

FIGS. 14, 15 and 16 are plan views showing some possible compositions of components A, B and C, to form a bath-room.

According to FIG. 14, components A and B are located near each other on the same side of the room, while component C is arranged on the transversal side.

According to FIG. 15, components A and B face each other on opposite sides and component C is arranged on the transversal side.

On the other hand, FIG. 17 schematically shows the possibility of combining components A and B in a single component A+B, wherein the water closet bowl and bidet appliances are located on the opposite side of the wash-basin.

Of course, all of these arrangements are merely indicative and no limits exist as to further possible compositions and combinations.

FIGS. 14–16 also show the components connections to a floor tap box, prearranged within the enclosure accomodating the components. whereas Referring to FIGS. 12 and 13, said tap box and associated connections will now be more particularly described in connection with an example of application. The box, generally indicated by E, can be provided as a floor built-in box and comprises a length of discharge pipe 100 and two lengths of pipes 101 and 102 for cold water and hot water, respectively, said pipe lengths being connected to respective vertical risers 103, 104 and 105 by connection lengths and terminating into proper pipe fittings 106, 107 and 108, to which can be attached connection pipes 109, 110 and 111, being totally or partially flexible and leading to the respective pipe fittings provided on the hygienic-sanitary components. The discharge connection pipe 109 may have an offtake 112 for mere water discharge, where s the pipe 109 of a larger diameter is connected to the water closet bowl discharge.

The tap box is suitably closed by a cover or lid 113. The flexible connection pipes between said tap box and the hygienic-sanitary component, which are arranged above floor level, can be concealed by simple box-like structures or the like (not shown) forming for example raised step zones, at definite locations of the bath-room, also performing an ornamental function.

The many advantages of the present invention are as follows:

(a) first and basically, the hygienic-sanitary components can be positioned in a bath-room according to an arrangement as desired by the user, just as any other piece of furniture;

(b) owing to the use of flexible connecting pipes, these hygienic-sanitary components can be more readily and simply moved from one position to another;

(c) when positioned on floor level, the flexible connecting pipes can be concealed by flat box-like units forming ornamental step elements, and when wall positioned, such pipes can be covered by box-like units forming supporting shelves;

(d) in both of these two last mentioned cases, the flexible pipes can be more easily checked by simply removing said covering box-like units, when having to provide for repairs on broken, worn or clogged pipes, thus avoiding having to break and rebuild the wall structures;

(e) the positioning and connection of the hygienic-sanitary components are preferably carried out when the bath-room is entirely finished and cleaned, thereby avoiding the risk that such components may get soiled or damaged by the workers assigned to the building erection;

(f) the replacement of one or more hygienic-sanitary components — for instance because they are damaged or worn or too old — is extremely easy and rapid, so that it can be carried out even when desiring to change the home furnishing;

(g) similarly, one or more components can be added or removed from a determined facility composition, when such a composition is no longer consistent with the user's requirements;

(h) finally, the installation of the hydraulic elements which should anyhow be applied during building erection, will be reduced to a minimum, substantially comprising only the risers and discharge pipes, in addition to the aforesaid tap boxes, whereby simplicity and rationality in construction can be achieved.

The invention has been illustrated on the ground of some embodiments, which are to be considered as merely indicative and not restrictive, since many changes, combinations and modifications can be made thereto within the scope of the invention.

I claim:

1. A prefabricated hygienic-sanitary bath-room and toilet outfit, comprising a self-supporting water closet and a bath-tub each piece in the form of a furniture piece including flow regulating means, each completely finished with panels, each of said water closet and bath-tub furniture pieces having pipe fittings mounted thereon, flexible feed and flexible discharge pipes for each of said water closet and bath-tub secured to said bath-tub and water closet pipe fittings, a tap box mounted in the bathroom said flexible pipes being connected to respective pipe fittings assembled in said tap box, means for concealing the flexible pipes and the top box, and each of said water closet and bath-tub being movable without being disconnected from said tap box.

2. The bath-room and toilet outfit according to claim 1, wherein each of said bath-tub and water closet is of modular size.

* * * * *